US006068444A

United States Patent [19]

Sheth

[11] Patent Number: 6,068,444

[45] Date of Patent: May 30, 2000

[54] SUBMERGIBLE CENTRIFUGAL PUMP HAVING IMPROVED DIFFUSER BUSHINGS

[75] Inventor: Ketankumar K. Sheth, Tulsa, Okla.

[73] Assignee: Camco International, Inc., Houston, Tex.

[21] Appl. No.: 09/135,351

[22] Filed: Aug. 17, 1998

[51] Int. Cl.[7] ..... F01D 1/02

[52] U.S. Cl. ..... 415/199.2; 415/104; 415/174.3; 417/424.1

[58] Field of Search ..... 415/104, 111, 415/170.1, 174.3, 199.1, 199.2, 199.3, 229, 107; 384/299, 420, 913; 417/424.1

[56] References Cited

U.S. PATENT DOCUMENTS

| | | | |
|---|---|---|---|
| 4,063,846 | 3/1998 | Eagle | 415/199.2 |
| 4,678,399 | 7/1987 | Vandevier et al. | 415/199.2 |
| 4,741,668 | 5/1988 | Bearden | 415/212 |
| 4,781,531 | 11/1988 | James | 415/212 |
| 4,838,758 | 6/1989 | Sheth | 415/140 |
| 4,872,808 | 10/1989 | Wilson | 415/170.1 |
| 5,722,812 | 3/1998 | Knox et al. | 415/199.1 |

*Primary Examiner*—Edward K. Look
*Assistant Examiner*—James M McAleenan
*Attorney, Agent, or Firm*—Fletcher, Yoder & Van Someren

[57] ABSTRACT

A submergible, centrifugal pump utilizes an improved bushing system for absorbing downthrust at each stage of the pump. The centrifugal pump is a multi-stage pump having a plurality of impellers keyed to a rotatable shaft. Diffusers cooperate with the impellers to conduct the pumped fluid upwardly from one impeller to the next. The improved support system comprises simple diffuser bushings that are generally cylindrical in shape, and relatively inexpensive to manufacture. Each diffuser bushing is disposed between a diffuser and the next upwardly sequential impeller to support that impeller with respect to the downthrust created during pumping.

21 Claims, 3 Drawing Sheets

SUBMERGIBLE CENTRIFUGAL PUMP HAVING IMPROVED DIFFUSER BUSHINGS

FIELD OF THE INVENTION

The present invention relates generally to submergible, centrifugal pumps, such as those used in wellbores for pumping oil, and in particular to centrifugal pumps utilizing improved diffuser bushings that bear the axial thrust generated by each impeller during pumping.

BACKGROUND OF THE INVENTION

Submergible pumps are used in a wide variety of environments. One exemplary environment is a subsurface oil reservoir. A submergible pumping system, having a submergible, centrifugal pump, is inserted into the subsurface oil via a wellbore to permit the pumping of oil to a point at or above the surface. The typical submergible pump includes several impellers mounted to a shaft for rotation within an outer housing of the pump. A diffuser cooperates with each impeller to guide the fluid in the direction of flow from one impeller to the next sequential impeller.

Often, the fluid is pumped vertically upward which creates a downthrust at each impeller. The downthrust must be absorbed by some type of bearing or bearings to avoid damage to the submergible pump. Typically, this downthrust is absorbed at each stage, i.e., at each impeller/diffuser, or by a single large thrust bearing disposed somewhere beneath the entire series of impellers and diffusers. The present invention addresses submergible, centrifugal pumps that attempt to receive and handle the downthrust at each stage, sometimes referred to as floating-pump systems.

The downthrust created by the pumping action is handled at each stage by a stationary support that effectively supports each rotating impeller. For example, each stationary diffuser may include a diffuser pedestal on which the next upwardly sequential impeller is supported. Typically, a thrust washer is disposed between the diffuser pedestal and the supported surface of the impeller. Alternatively, a diffuser thrust pad is mounted to or with each diffuser to, again, provide a support platform on which the next upwardly sequential impeller rests. A thrust washer is disposed between the diffuser thrust pad and the supported surface of the impeller.

With either of the above designs, the diffuser pedestal and the thrust pad generally have complex shapes that are expensive to manufacture. For example, the typical thrust pad is made from an extremely hard material and includes a flared upper region having a top surface over which the thrust washer slides during rotation of the adjacent impeller. Because of the type of material used in the thrust pad, it is relatively expensive to machine flared, curved, or expanded regions. Similarly, it is relatively expensive to form the integral diffuser pedestal.

It would be advantageous to create a relatively simple diffuser bushing having an outer surface with a generally constant radius to simplify the machining and thereby reduce the cost of the overall submergible pump.

SUMMARY OF THE INVENTION

The present invention features a submergible, centrifugal pump for pumping fluids. The centrifugal pump includes a rotatable shaft and a plurality of stages. Each stage includes an impeller, a diffuser, a radial bearing sleeve, a thrust washer and a diffuser bushing. The impeller includes a hub portion keyed to the shaft to insure that the impeller rotates with the shaft. A corresponding diffuser is disposed to cooperate with each of the impellers, and the thrust washer is attached to either the impeller or the shaft for rotation with the shaft. The radial bearing sleeve is disposed about the shaft approximate the hub portion to support the shaft. Each diffuser bushing is disposed between a diffuser and a corresponding thrust washer at a position radially outward from the radial bearing sleeve. Further, each diffuser bushing has an easy-to-machine shape generally in the form of a hollow cylinder.

According to another aspect of the invention, a diffuser bushing is provided for use between a diffuser and a thrust washer in a multi-stage, submergible, centrifugal pump of the type having a rotatable shaft mounted in a plurality of radial sleeve bearings. The diffuser bushing comprises a cylinder having a first end, a second end, and a hollow interior extending through the first and second ends along an axis. The hollow interior is defined by an inner wall, and the radial exterior of the cylinder is defined by an outer wall. The overall shape of the cylinder is relatively simple in that the outer wall is substantially equidistant from the axis at both the first end and the second end.

According to another aspect of the invention, a submergible, centrifugal pump, of the type designed for submersion in a liquid to be pumped to a higher elevation, includes an improved diffuser bushing system. The pump comprises an outer housing having a longitudinal axis and a plurality of radial bearings. A shaft is rotatably mounted in the plurality of radial bearings generally along the longitudinal axis. A plurality of rotable impellers are mounted sequentially along the longitudinal axis and a plurality of stationary diffusers are mounted for cooperation with the impellers in conducting fluid upwardly. A plurality of inner thrust washers cooperate with a plurality of diffuser bushings to support each impeller with respect to the next downwardly sequential diffuser. Each diffuser bushing is of a relatively simple design having an outer surface that extends substantially about the shaft while remaining substantially equidistant from the longitudinal axis.

BRIEF DESCRIPTION OF THE DRAWINGS

The invention will hereafter be described with reference to the accompanying drawings, wherein like reference numerals denote like elements.

DETAILED DESCRIPTION OF THE PREFERRED EMBODIMENT

Figure 1:
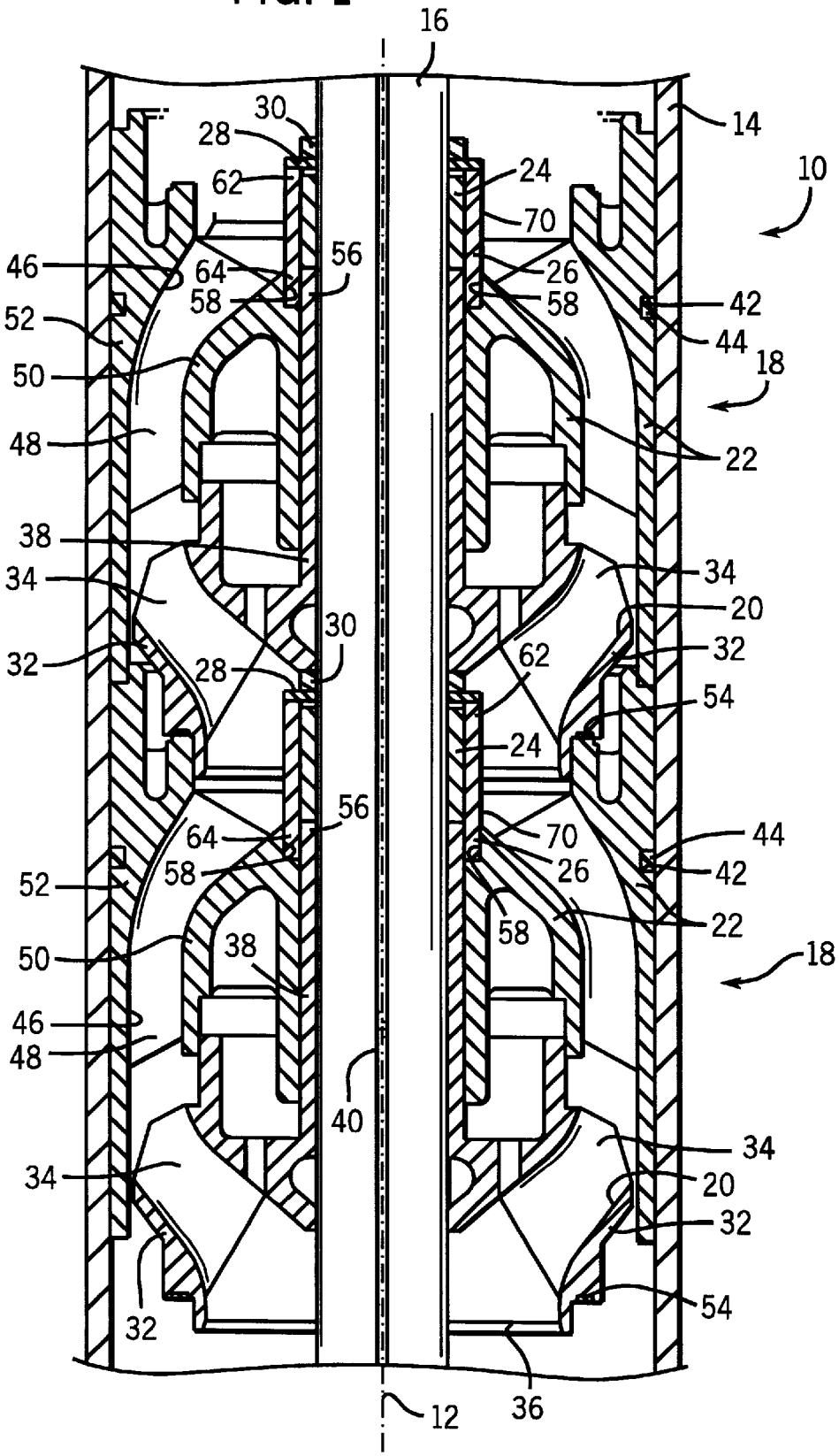
FIG. 1 is a cross-sectional view taken generally along the longitudinal axis of a plurality of stages within a submergible, centrifugal pump, according to a preferred embodiment of the present invention.

Referring generally to FIG. 1, a portion of a submergible, centrifugal pump 10, according to a preferred embodiment of the present invention, is illustrated in cross-section taken generally along a central longitudinal axis 12. Centrifugal pump 10 includes an outer housing 14 that is generally tubular in construction. Within outer housing 14, a shaft 16 is rotatably mounted generally along longitudinal axis 12.

Centrifugal pump 10 is constructed in a series of sequential stages 18 disposed within outer housing 14 along longitudinal axis 12. In the illustrated embodiment, two sequential stages 18 are shown stacked vertically above one another, although the full centrifugal pump 10 typically includes additional stages. Only two sequential stages 18 are shown for the purpose of clarity in description.

Each stage 18 generally includes an impeller 20, a diffuser 22, a radial bearing sleeve 24, a diffuser bushing 26, an inner downthrust washer 28, and a spacer 30. The components cooperate to pump a fluid, such as oil, from a lower impeller 20 through the next upwardly adjacent diffuser 22, to the next upwardly sequential impeller 20, through the next upwardly, sequential diffuser 22, etc. as is well-known by those of ordinary skill in the art. The pumping action is provided by the impellers 20 that are connected to shaft 16 for rotation therewith. The diffusers 22, on the other hand, are mounted in a stationary position within outer housing 14 to guide the pumped fluid from one impeller 20 to the next.

Specifically, each impeller 20 includes a plurality of vanes 32 each having a fluid path 34 for directing fluid upwardly to the next sequential diffuser 22 as the impeller 20 rotates with shaft 16. Each impeller 20 further includes an inlet opening 36 through which the pumped fluid enters, and an impeller hub portion 38 that lies along the circumference of shaft 16. Impeller 20 is fixed to shaft 16, at least with respect to rotation about shaft 16, by a key and keyway system 40.

Each diffuser 22 is fixed in a stationary position within outer housing 14 and preferably includes a seal ring groove 42 for receiving a seal 44 by which each diffuser forms a fluid seal with the interior surface of outer housing 14. Each diffuser 22 includes a plurality of diffuser veins 46 having passageways 48 defined by a radially inward diffuser portion 50 and a radially outward diffuser portion 52. The fluid forced upwardly by a given impeller 20 is directed through passageways 48 to the next sequential impeller 20.

Typically, an outer washer 54 is disposed between adjacent diffusers and impellers at a position radially outward from inner downthrust washer 28. Outer washers 54 potentially may be fashioned as thrust and/or sealing washers, generally made from a harder material, or sealing washers, generally made from a softer, more pliable material.

Figure 2:
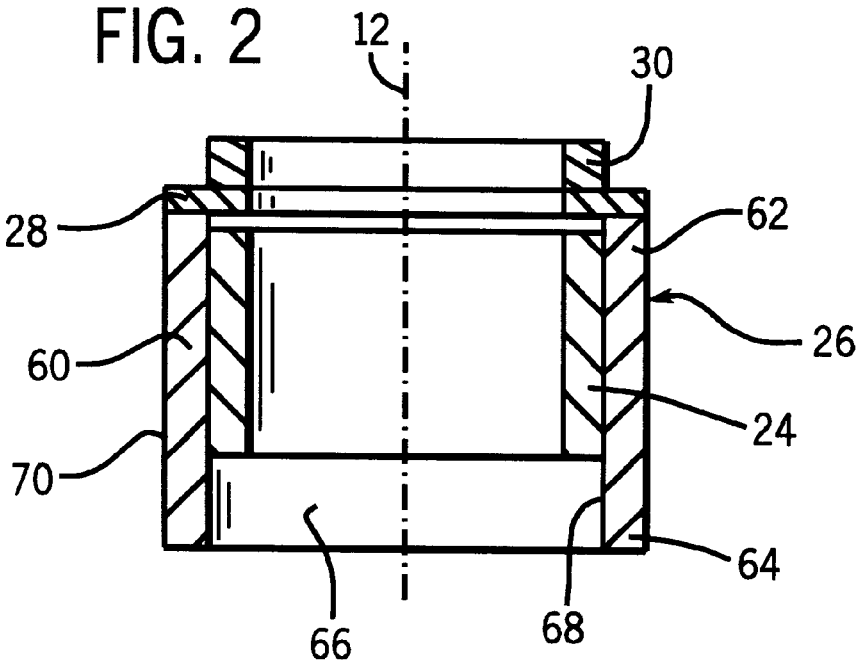
FIG. 2 is a cross-sectional view taken generally along a longitudinal axis of a diffuser bushing, according to a preferred embodiment of the present invention.

As illustrated in FIGS. 1 and 2, at each stage 18, the radial bearing sleeve 24 and diffuser bushing 26 are disposed concentrically about longitudinal axis 12. Specifically, the radial bearing sleeve 24 is disposed for sliding engagement with shaft 16 to support shaft 16 at a position adjacent a top portion 56 of impeller hub 38. The corresponding diffuser bushing 26 is mounted against its corresponding diffuser 22 and is disposed immediately radially outward from and adjacent to the corresponding bearing sleeve 24. Diffuser bushing 26 actually resides in a notch 58 formed in the top of inner diffuser portion 50, as illustrated best in FIG. 1.

Inner downthrust washer 28 preferably is affixed to its corresponding impeller 20 or shaft 16 and rotates against the top of diffuser bushing 26 above radial bearing sleeve 24. In this embodiment, spacer 30 is disposed between inner downthrust washer 28 and the lower end of impeller hub 38 to help support impeller 20 against the downthrust created during pumping. In other words, as each impeller 20 spins, it creates downthrust that acts through spacer 30 and inner downthrust washer 28, where it is absorbed by diffuser bushing 26, diffuser 22 and, ultimately, outer housing 14. Thus, the downthrust created by each impeller 20 is received and countered by the rigid connection to outer housing 14 via each diffuser 22 and diffuser bushing 26. If outer washer 54 is used as a thrust washer, it also transfers downthrust forces to diffuser 22 and outer housing 14.

The particular design of diffuser bushing 26 provides for economical manufacture and dependability. Specifically, diffuser bushing 26 is designed as a cylinder 60 having a first end 62, against which inner downthrust washer 28 acts, and a second end 64 opposite first end 62 along longitudinal axis 12. Cylinder 60 further includes a hollow interior 66 that extends through first end 62 and second end 64 along longitudinal axis 12.

Hollow interior 66 is defined by an inner wall 68, while the exterior of cylinder 60 is defined by an outer wall 70. Outer wall 70 is generally annular and equidistant from longitudinal axis 12 at both first end 62 and second end 64. In other words, outer wall 70 has the same radius at all points along first end 62 and second end 64. In the preferred embodiment, outer wall 70 is substantially equidistant from longitudinal axis 12 at all points providing a smooth surface from first end 62 to second end 64.

In the embodiment illustrated in FIGS. 1 and 2, inner wall 68 also is equidistant from longitudinal axis 12 at all points along first end 62 and second end 64. Preferably, inner wall 68 is substantially equidistant from longitudinal axis 12 at all points to provide a smooth surface from first end 62 to second end 64 that readily slides over radial bearing sleeve 24, as best illustrated in FIG. 2. This simple, cylindrical design of diffuser bushing 26 provides a component that is economical to manufacture and also dependable in function.

Various materials may be used to make inner downthrust washer 28 and diffuser bushing 24. For example, downthrust washer 28 may be made from tungsten carbide, PEEK-reinforced polymer, heat-treated steel and coated tool steel. Similarly, diffuser bushing 26 is constructed from a hard material, such as tungsten carbide, PEEK-reinforced polymer, heat-treated steel or coated tool steel.

Figure 4:
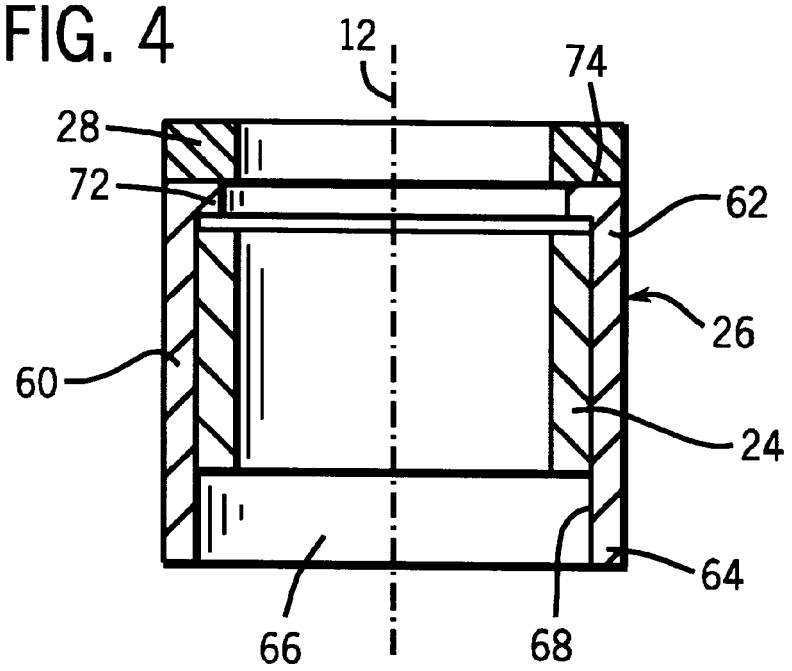
FIG. 4 is a cross-sectional view of the diffuser bushing assembly illustrated in FIG. 3.
Figure 3:
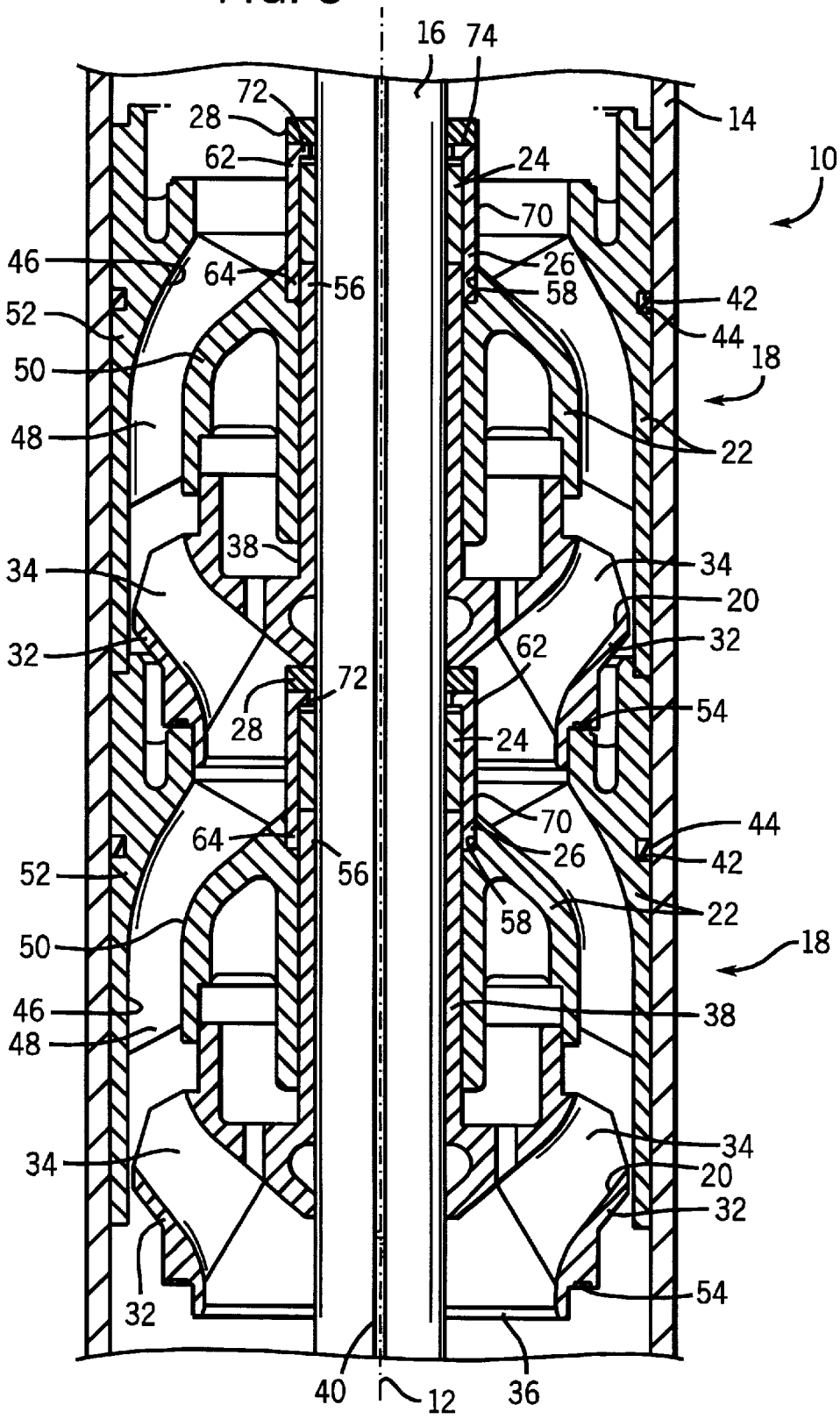
FIG. 3 is an alternate embodiment of the submergible, centrifugal pump illustrated in FIG. 1.

An alternate embodiment of the present invention is illustrated in FIGS. 3 and 4. The majority of components are the same as in FIGS. 1 and 2, so that common reference numerals are used throughout. The primary difference is the shape of diffuser bushing 26. In this particular embodiment, diffuser bushing 26 has a slightly thinner wall and is not formed all the way through first end 62 and second end 64. Specifically, a tab portion 72 extends radially inward from inner wall 68 along first end 62. Tab portion 72 resides above radial bearing sleeve 24 and provides a contact surface 74 for downthrust washer 28. In this design, the outer wall or outer surface 70 remains equidistant from longitudinal axis 12 at both first end 62 and second end 64. Preferably, outer wall 70 is equidistant from longitudinal axis 12 throughout. This design also helps reduce the cost of manufacture by avoiding any machining or other forming processes that would otherwise be applied to create a shaped or contoured outer wall. In the embodiment illustrated in FIGS. 3 and 4, a combined downthrust washer 28 and spacer 30 can be used. In the alternative, however, a thicker downthrust washer 28, as illustrated, can be used in place of the combined thrust washer and spacer.

It will be understood that the foregoing description is of preferred exemplary embodiments of this invention and that the invention is not limited to the specific forms shown. For example, a variety of impellers, diffusers, and downthrust washers can be used. Various materials may be used in making the components. The number of stages can be selected according to the particular pump design. A variety of submergible motors may be connected to the shaft for powering the submergible pump. These and other modifications may be made in the design and arrangement of the elements without departing from the scope of the invention as expressed in the appended claims.

What is claimed is:

1. A submergible, centrifugal pump for pumping a fluid, comprising:

a rotatable shaft;

a plurality of stages, each stage including;

an impeller having a hub portion disposed along the shaft and connected to the shaft such that the impeller rotates with the shaft;

a diffuser disposed to cooperate with the impeller;

a radial bearing sleeve disposed about the shaft proximate the hub portion;

a thrust washer that rotates with the shaft;

and a diffuser bushing having the shape of a hollow cylinder, the diffuser bushing being disposed between the diffuser and the thrust washer at a position radially outward from the radial bearing sleeve.

2. The submergible pump as recited in claim 1, further comprising an outer thrust washer disposed between the diffuser and a next adjacent impeller.

3. The submergible, centrifugal pump as recited in claim 1, further comprising an outer sealing washer disposed between the diffuser and a next adjacent impeller.

4. The submergible, centrifugal pump as recited in claim 1, further comprising an outer thrust and sealing washer disposed between the diffuser and a next adjacent impeller.

5. The submergible, centrifugal pump as recited in claim 1, wherein the thrust washer comprises tungsten carbide.

6. The submergible, centrifugal pump as recited in claim 1, wherein the thrust washer comprises heat-treated steel.

7. The submergible, centrifugal pump as recited in claim 1, wherein the diffuser bushing comprises tungsten carbide.

8. The submergible, centrifugal pump as recited in claim 1, wherein the thrust washer is affixed to the impeller for rotation therewith.

9. The submergible, centrifugal pump as recited in claim 1, wherein the diffuser bushing is in rotating contact with a radially outward surface of the radial bearing.

10. The submergible, centrifugal pump as recited in claim 1, further comprising a spacer disposed between the diffuser bushing and a next adjacent impeller.

11. A diffuser bushing for use between a diffuser and a thrust washer in a multi-stage submergible, centrifugal pump of the type having a rotatable shaft mounted in a plurality of radial sleeve bearings, comprising:

a cylinder having a first end, a second end and a hollow interior extending through the first end and the second end along an axis, the hollow interior being defined by an inner wall and the radial exterior of the cylinder being defined by an outer wall, wherein the outer wall is substantially equidistant from the axis at both the first end and the second end.

12. The diffuser bushing as recited in claim 11, wherein the cylinder is made from a material comprising tungsten carbide.

13. The diffuser bushing as recited in claim 11, wherein the cylinder is made from a material comprising PEEK reinforced polymer.

14. The diffuser bushing as recited in claim 11, wherein the cylinder is made from a material comprising heat-treated steel.

15. The diffuser bushing as recited in claim 11, wherein the cylinder is made from a material comprising coated tool steel.

16. The diffuser bushing as recited in claim 11, wherein the cylinder includes a tab portion extending inwardly from the inner wall at one of the first end or the second end.

17. A submergible, centrifugal pump having an improved diffuser bushing system, the submergible, centrifugal pump being designed for submersion in a liquid to be pumped to a higher elevation, comprising:

an outer housing having a longitudinal axis;

a plurality of radial bearings;

a shaft rotatably mounted along the longitudinal axis in the plurality of radial bearings;

a plurality of rotatable impellers mounted sequentially along the longitudinal axis;

a plurality of stationary diffusers;

a plurality of inner thrust washers; and a plurality of diffuser bushings with at least one diffuser bushing disposed between each thrust washer and each diffuser, each diffuser bushing having an outer surface that extends substantially about the shaft while remaining substantially equidistant from the longitudinal axis.

18. The submergible, centrifugal pump as recited in claim 17, wherein each inner thrust washer is affixed to a corresponding impeller.

19. The submergible, centrifugal pump as recited in claim 17, wherein each diffuser bushing includes an inner surface that extends substantially about the shaft while remaining substantially equidistant from the longitudinal axis.

20. The submergible, centrifugal pump as recited in claim 17, further comprising a plurality of outer washers disposed radially outward from the inner thrust washers.

21. The submergible, centrifugal pump as recited in claim 19, wherein the outer surface and the inner surface both are substantially smooth.

* * * * *